United States Patent [19]

Zaborowski

[11] Patent Number: 4,852,546

[45] Date of Patent: Aug. 1, 1989

[54] HAIR ROLLER HEATING DEVICE

[75] Inventor: Thaddeus Zaborowski, Cambridge, Mass.

[73] Assignee: The Schawbel Corporation, Cambridge, Mass.

[21] Appl. No.: 226,730

[22] Filed: Aug. 1, 1988

Related U.S. Application Data

[63] Continuation-in-part of Ser. No. 825,275, Feb. 3, 1986, Pat. No. 4,699,123, and a continuation-in-part of Ser. No. 56,447, Jun. 1, 1987, Pat. No. 4,776,321, which is a continuation-in-part of Ser. No. 781,262, Sep. 27, 1985, Pat. No. 4,733,651.

[51] Int. Cl.[4] ..... A45D 4/00

[52] U.S. Cl. ..... 126/403; 126/408; 132/227

[58] Field of Search ..... 126/402–409, 126/38; 132/226, 227

[56] References Cited

U.S. PATENT DOCUMENTS

| | | | |
|---|---|---|---|
| 3,430,622 | 3/1969 | Webster et al. | 126/38 |
| 4,584,462 | 4/1986 | Morrison | 219/222 |
| 4,658,114 | 4/1987 | Hong | 219/222 |
| 4,776,321 | 10/1988 | Schawbel et al. | 126/409 |

FOREIGN PATENT DOCUMENTS

| | | | |
|---|---|---|---|
| 1320226 | 1/1963 | France | 126/38 |

*Primary Examiner*—Martin P. Schwadron

*Assistant Examiner*—Allen J. Flanigan

*Attorney, Agent, or Firm*—Andrew S. Langsam

[57] ABSTRACT

A portable hair roller heating device includes a housing defined by top, side and bottom walls, the top wall including apertures through which elongated hair rollers can be inserted into the housing; a heating chamber in the housing for heating the hair rollers inserted through the apertures; two burner tubes with free ends extending into the heating chamber; a fuel delivery system for supplying fuel to the heating chamber through the burner tubes; an ignition device for igniting the fuel supplied to the heating chamber by the burner tubes so as to heat the chamber; a plurality of heat conducting tubes positioned adjacent the heating chamber and in line with the plurality of apertures for supporting the hair rollers in the housing and for conducting heat to the hair rollers from the heating chamber; a first screw-threaded well in the top wall for removably connecting a fuel supply cartridge thereto in an inoperative state when the heating appliance is not being used; a second screw-threaded well in the bottom wall for removably connecting the fuel supply cartridge thereto to supply fuel to the fuel delivery system when the heating appliance is in use; and a removable cover selectively connectable to either the top wall to cover portions of the hair rollers extending through the top wall and the cartridge in the first well, or the bottom wall of the housing so as to support the housing and the cartridge in the second well.

17 Claims, 5 Drawing Sheets

HAIR ROLLER HEATING DEVICE

REFERENCE TO RELATED APPLICATION

This application is a Continuation-In-Part of copending U.S. patent application Ser. No. 06/825,275, filed Feb. 3, 1986 entitled PORTABLE HEATING APPLIANCE to Thaddeus Zaborowski, now U.S. Pat. No. 4,699,123, and is also a Continuation-In-Part of copending U.S. patent application Ser. No. 07/056,447, filed June 1, 1987, entitled HAIR ROLLER HEATING DEVICE to William Schawbel et al., now U.S. Pat. No. 4,776,321, both of which, in turn, are Continuation-In-Part Applications of copending U.S. patent application Ser. No. 06/781,262, filed Sept. 27, 1985, entitled PORTABLE CURLING IRON, to William Schawbel et al., now U.S. Pat. No. 4,733,651 all three applications have a common assignee herewith and the entire disclosures of all three applications being incorporated herein by reference.

BACKGROUND OF THE INVENTION

This invention relates generally to portable heating appliances and; more particularly, is directed to a novel hair roller heating device.

Women often use hair rollers to set their hair with particular curls, waves and the like. It has been found that this is accomplished more easily if the hair rollers are flexible and heated. Accordingly, hair rollers have been developed comprised of a flexible plastic tube surrounding a flexible metal coil spring. In the unflexed state, the coil spring forces the plastic tube into a linear arrangement.

In addition, devices for heating these hair rollers have also been developed, whereby the metal coil is heated directly. For example, one such hair roller heating device is sold by Conair Corporation, 11 Executive Avenue, Edison, N.J., under the trademark "Hot Sticks". With this device, tight curls, soft curls and body waves can be achieved.

The Conair device includes a hollow housing having a plurality of spaced openings in the upper surface thereof through which the hair rollers can be inserted. Heating means is positioned within the housing and generally includes a plurality of metal tubes positioned with a vertical orientation in the housing below the openings. Thus, the hair rollers fit through the openings in the housing and are lodged in the metal tubes. The metal tubes are heated by a flexible, electrically resistive element, which is wrapped once around a tube, then transverses the distance to the next tube around which the element is again wrapped and so on until each tube has been wrapped, thereby requiring an electric supply cord and a plug connected to the electric heating means. This is disadvantageous from a number of respects. First, if there is no electric outlet, heating cannot be performed. Second, the use of an electric cord restricts placement of the device and may be dangerous if it becomes tangled or the like. Third, the construction is complicated due to the requirements of the multitude of wrappings in the electric heating elements.

Of similar import is the hair roller heating device described and shown in U.S. Pat. No. 4,584,462. This Patent also states very generally that other energy sources such as butane catalytic heat sources could be used.

Curling irons which heat the barrel with a portable fuel source, such as catalytic gas, are also well known.

The catalytic converters thereof are powered by butane or similar type gases which may take the form of replaceable or refillable cartridges. Such portable curling irons are widely used, and may be conveniently used almost anywhere.

Catalytic burners for portable curling irons suffer from several disadvantages. First, they are slow to heat and expensive to manufacture, which are clearly undesirable. Additionally, if the temperature runs too high, the platinum catalyst sinters, reducing surface area, which reduces life.

Still further, catalytic converters can suffer from "hot spots" which can render them dangerous.

In the aforementioned U.S. patent application Ser. No. 07/056,447, the entire disclosure of which has been incorporated herein by reference, a portable hair roller heating device is described in which a chamber is formed, the upper wall of the chamber having a plurality of apertures therein, through which a plurality of flexible hair rollers can be positioned for heating. The chamber is heated by burning a fuel. However, such device has the same general configuration as the aforementioned hair roller heating device sold by Conair Corporation under the trademark "Hot Sticks". Accordingly, such device occupies a great amount of bathroom or other counter space and is extremely inconvenient for traveling.

OBJECTS AND SUMMARY OF THE INVENTION

Accordingly, it is an object of this invention to provide a portable hair roller heating device.

It is another object of this invention to provide a portable hair roller heating device that does not require an electric current to operate.

It is still another object of this invention to provide a portable hair roller heating device which is readily adaptable to portable use, yet which permits rapid heating of the hair rollers therein.

It is a further object of this invention to provide a portable hair roller heating device in which the operating temperature is maintained substantially constant.

It is still further object of this invention to provide a portable hair roller heating device in which a source of fuel is employed which may be rechargeable or refillable.

It is another object of this invention to provide a portable hair roller heating device which is safe to use.

It is still another object of this invention to provide a portable hair roller heating device which is extremely compact.

It is yet another object of the present invention to provide a portable hair roller heating device in which a fuel supply cartridge is stored in a well on top of the device when not in use and which is connectable to a well in the bottom of the device when in use.

It is a further object of the present invention to provide a portable hair roller heating device in which the cover protects the hair rollers extending from the top of the housing and the cartridge secured thereto when in its stored position, and which is connectable to the bottom of the housing to function as a stand and to protect the cartridge secured thereat.

In accordance with an aspect of the present invention, a portable heating appliance includes a housing defined by a top wall, side wall and bottom wall, the top wall including a plurality of apertures through which a plurality of elongated objects can be inserted into the housing; a heating chamber in the housing for heating the objects inserted through the apertures; at least one burner tube with a free end extending into the heating chamber; fuel delivery means for supplying fuel to the heating chamber through the at least one burner tube; ignition means for igniting the fuel supplied to the heating chamber by the at least one burner tube so as to heat the chamber; first securing means in one wall of the housing for removably connecting a fuel supply cartridge thereto in an inoperative state when the heating appliance is not being used; and second securing means in another wall of the housing for removably connecting the fuel supply cartridge thereto in an operative state to supply fuel to the fuel delivery means when the heating appliance is in use.

In accordance with another aspect of the present invention, a portable heating appliance includes a housing defined by a top wall, side wall and bottom wall, the top wall including a plurality of apertures through which a plurality of elongated objects can be inserted into the housing; a plurality of metal tubes positioned with a vertical orientation in the housing below the openings; a heating chamber in the housing for heating the plurality of tubes and their elongated object contents; at least one burner tube with a free end extending into the heating chamber; fuel delivery means for supplying fuel to the heating chamber through the at least one burner tube; ignition means for igniting the fuel supplied to the heating chamber by the at least one burner tube so as to heat the chamber; a removable cover selectively connectable to either the top wall to cover portions of the objects extending through the top wall, or the bottom wall of the housing so as to support the housing; first securing means in the top wall for removably connecting a fuel supply cartridge thereto when the heating appliance is not being used; second securing means in the bottom wall for removably connecting the fuel supply cartridge thereto to supply fuel to the fuel delivery means when the heating appliance is in use; and the cartridge being positioned within the cover when the cover is connected to the top wall and the cartridge is secured by the first securing means, and the cartridge has been positioned within the cover when the cover is connected to the bottom wall and the cartridge is secured by the second securing means.

In accordance with still another aspect of the present invention, a portable heating appliance includes a housing defined by a top wall, side wall and bottom wall, the top wall including a plurality of apertures through which a plurality of elongated hair rollers can be inserted into the housing; a heating chamber in the housing for heating the hair rollers inserted through the apertures; at least one burner tube with a free end extending into the heating chamber; fuel delivery means for supplying fuel to the heating chamber through the at least one burner tube; ignition means for igniting the fuel supplied to the heating chamber by the at least one burner tube so as to heat the chamber; a plurality of heat conducting tube means positioned adjacent the heating chamber and in line with the plurality of apertures for supporting the hair rollers in the housing and for conducting heat to the hair rollers from the heating chamber; a removable cover selectively connectable to either the top wall to cover portions of the hair rollers extending through the top wall, or the bottom wall of the housing so as to support the housing; first securing means in the top wall for removably connecting a fuel supply cartridge having external screw threads thereto when the heating appliance is not being used, the first securing means including a well defined in the top wall, the well having internal screw threads for screw-threadedly receiving the cartridge therein in an inoperative state; second securing means in the bottom wall for removably connecting the fuel supply cartridge thereto to supply fuel to the fuel supply means when the heating appliance is in use, the second securing means including a well defined in the bottom wall, the well having internal screw threads for screw-threadedly receiving the cartridge therein in an operative state so as to fluidly connect the cartridge to the fuel delivery means; and the cartridge being positioned within the cover when the cover is connected to the top wall and the cartridge is secured by the first securing means, and the cartridge being positioned within the cover when the cover is connected to the bottom wall and the cartridge is secured by the second securing means.

The above and other objects, features and advantages of the present invention will become readily apparent from the following detailed description which is to be read in connection with the accompanying drawings.

DETAILED DESCRIPTION OF A PREFERRED EMBODIMENT

Figure 1:
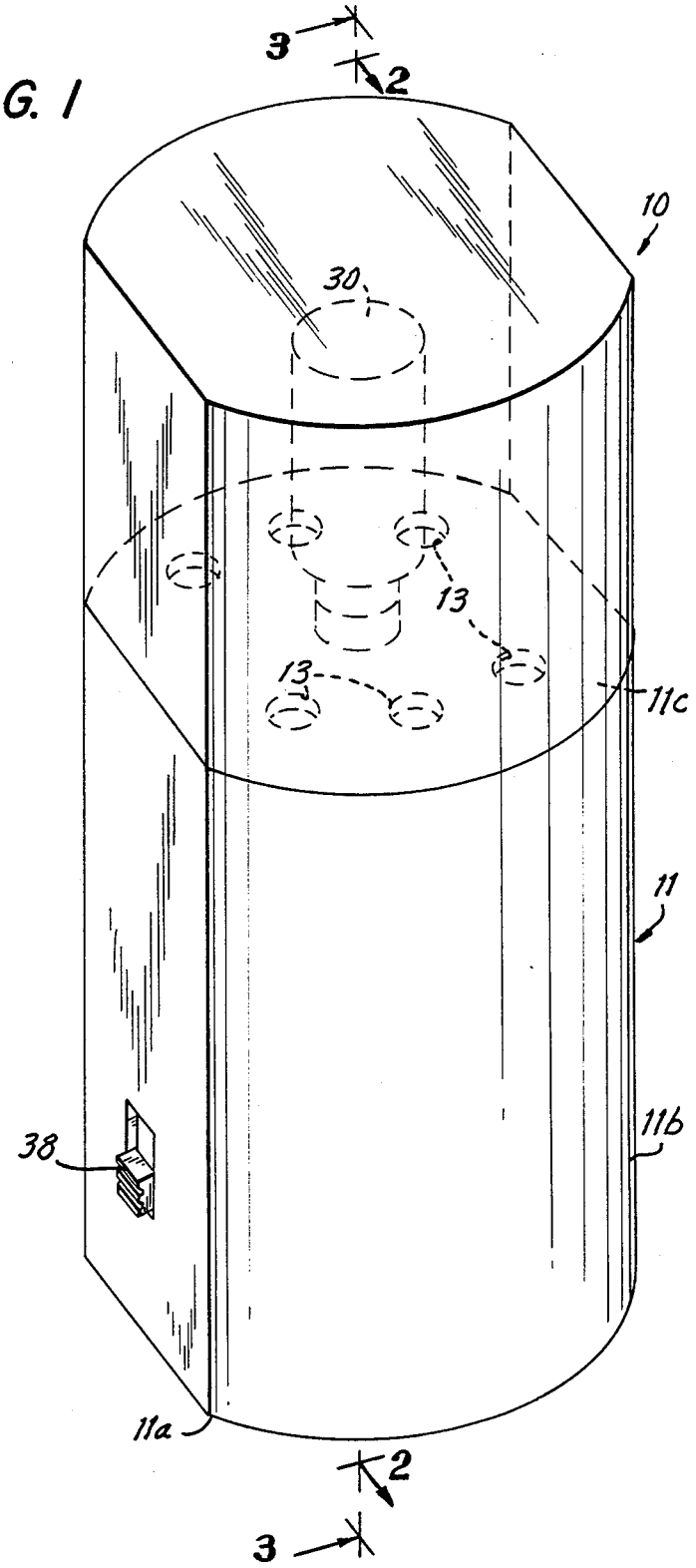
FIG. 1 is a perspective view of a portable hair roller heating device according to the present invention.
Figure 2:
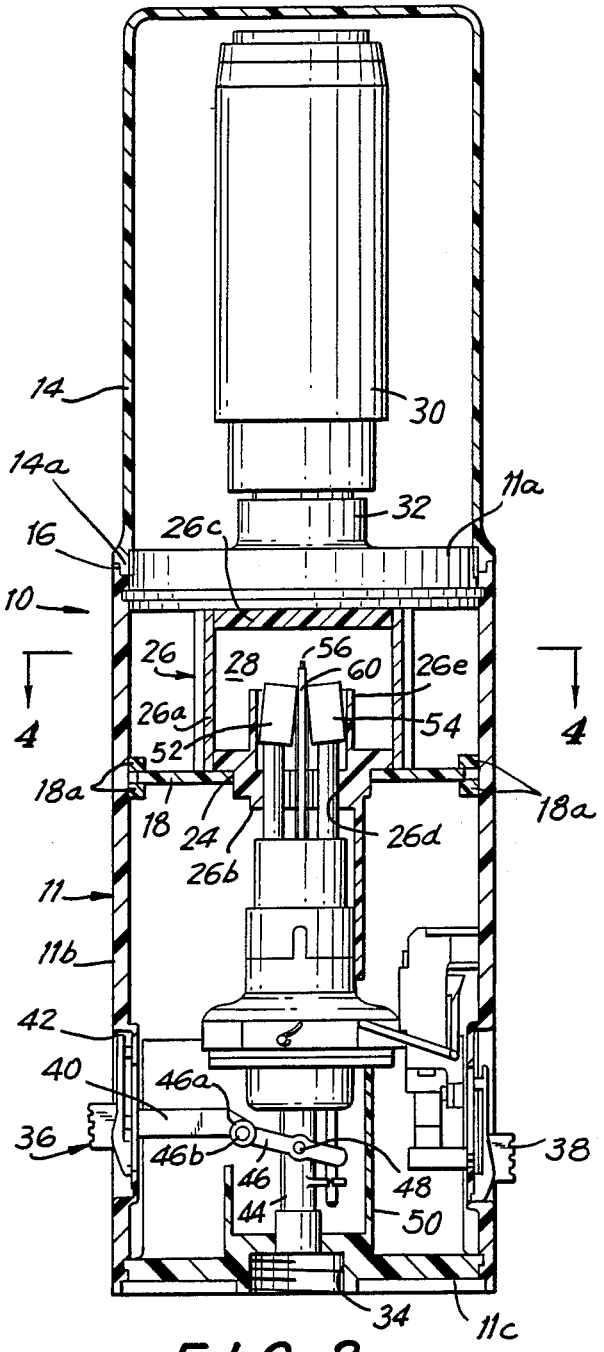
FIG. 2 is a cross-sectional view of the portable hair roller heating device of FIG. 1, taken along line 2—2 thereof.
Figure 3:
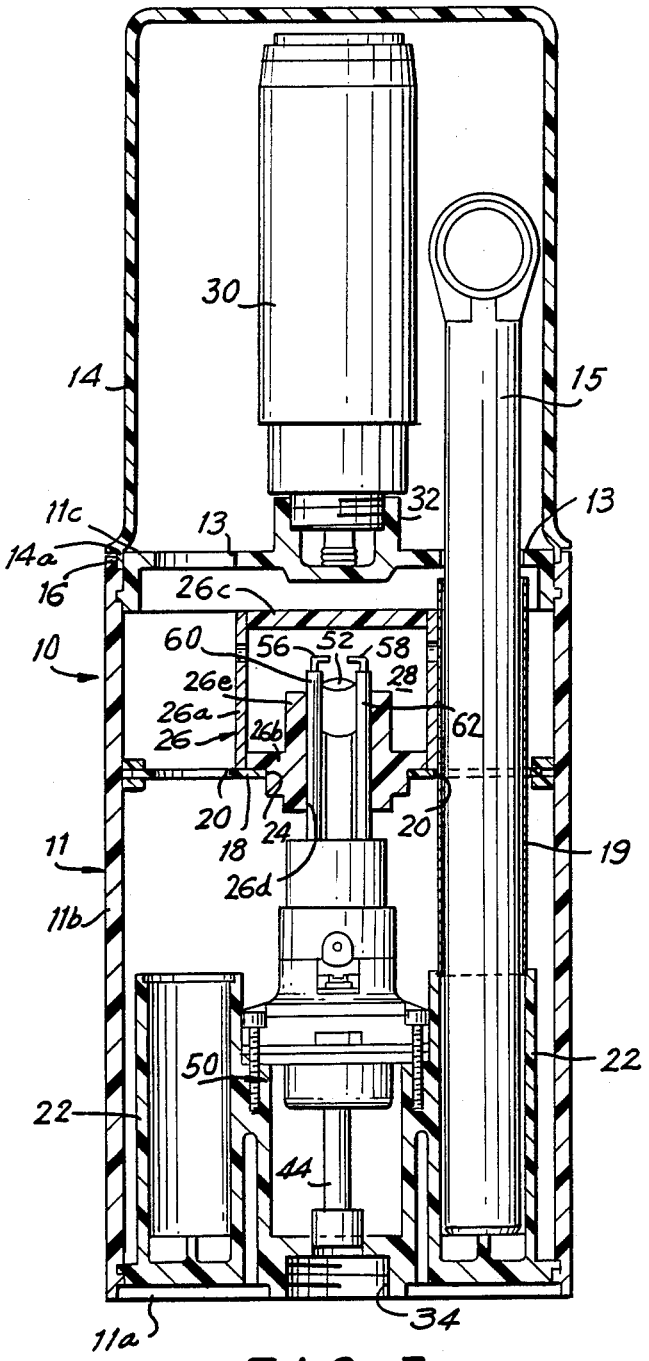
FIG. 3 is a cross-sectional view of the portable hair roller heating device of FIG. 1, taken along line 3—3 thereof.
Figure 4:
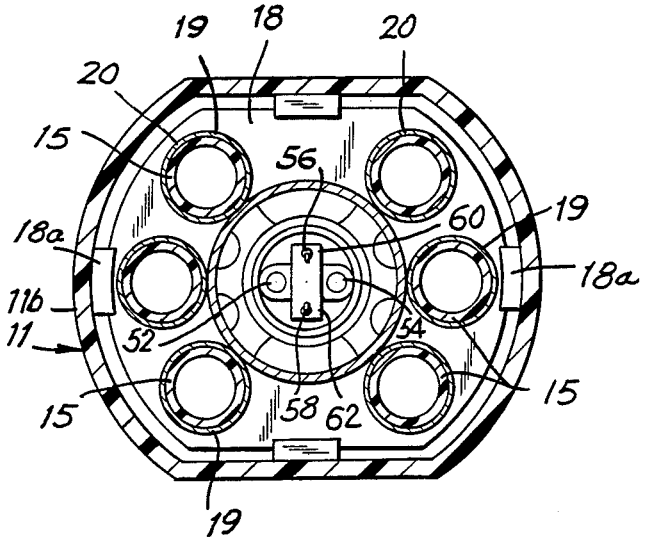
FIG. 4 is a cross-sectional view of the portable hair roller heating device of FIG. 2, taken along the line 4—4 thereof.

Referring to the drawings in detail, a portable hair roller heating device 10 according to the present invention includes a housing 11 having a generally circular cross-sectional configuration, with flattened sides, as shown in FIG. 1, and having its height as its greatest dimension, although the present invention is not limited by this configuration. Housing 11 is preferably made of a sturdy plastic material, and is hollow, as shown in FIGS. 2 and 3. Housing 11 is defined by a bottom wall 11*a*, a generally curved side wall 11 *b* and a top wall 11*c*. A plurality of circumferentially spaced apertures 13 are provided in top wall 11*c*, through which flexible hair rollers 15 can be inserted, as will become apparent from the description which follows, for heating the same. Although six apertures 13 are shown, the present invention is not limited thereto.

A cup-shaped cover 14 is removably connected to a peripheral part of top wall 11*c*. Specifically, an annular recess 16 is formed at the meeting of side wall 11*b* with top wall 11*c*. Cover 14 includes an annular projection 14*a* at the free open end thereof which fits tightly within annular recess 16 so as to lockingly secure cover 14 to housing 11.

The arrangement thus far described is different from the aforementioned hair roller heating device sold by Conair. With the present invention, there are no electric heating means or electric heating elements for each hair roller. Rather, the present invention uses a butane or other suitable gas to heat hair rollers 15.

A plate 18 extends in spaced, parallel relation to top wall 11*c*, within housing 11, plate 18 also including a plurality of circumferentially spaced apertures 20 for receiving hair rollers 15 that extend through apertures 13 into housing 11, with apertures 20 being in line and of the same number as apertures 13. For example, plate 18 can be secured within slotted members 18*a* secured to the inner surface of side wall 11*b* of housing 11. A plurality of metal tubes 19 made, for example, of aluminum, are inserted through each pair of aligned apertures 13 and 20 and have their lower ends fit within respective cylindrical guide walls 22 which are formed on bottom wall 11*a*. Cylindrical guide walls 22 are preferably formed from a heat insulating plastic material. As will be understood from the description which follows, hair rollers 15 are positioned through apertures 13 and fit within metal tubes 19.

An alternative embodiment for the heat exchanger consists of three basic pieces. An inner member of one piece (or two pieces connected together) can form the side walls of the combustion chamber and the inside curved walls of each of the six roller heating tubes. The inner piece can be either of stamped or extruded aluminum. An outer member or piece, also of stamped or extruded aluminum, forms the outside curved walls of each of the six roller heating tubes. A top piece or cover forms the top of the combustion chamber, when the top is secured, as by rivets, screws, etc., to the inner and outer pieces. The top piece has outer edges in direct contact with the inner wall of the inner piece to thereby promote the flow of heat between the roller heater elements. Thus, the inner piece, outer piece and top piece, when assembled together, form a heating chamber and six cylinderical roller heating tubes surrounding the chamber.

Plate 18 is also formed with a central aperture 24, within which is fit an enclosure 26 that defines a heating chamber 28 therein. Specifically, enclosure 26 is formed by an aluminum sleeve 26*a* that forms an annular side wall, a reduced dimension bottom wall 26*b* that sits in central aperture 24 and a top wall 26*c* that closes enclosure 26 to define heating chamber 28 therein. Bottom wall 26*b* includes a central aperture 26*d* and an inner guide sleeve 26*e* extends upwardly from bottom wall 26*b* in surrounding relation to central aperture 26*d* thereof. The burning of the butane gas occurs in heating chamber 28, as will be described in greater detail hereinafter. As can be seen from the drawings, metal tubes 19 surround and are in contact with aluminum sleeve 26*a* that defines heating chamber 28. Accordingly, when heating chamber 28 is heated up, it in turn heats metal tubes 19, which heat hair rollers 15. When the hair rollers 15 are heated, they are pulled out by the user.

As discussed above, hair roller heating device 10 is gas fueled, the gas being carried in a fuel cartridge 30 and transported to the delivery end by a sintered plastic wick (not shown). Cartridge 30 may be refillable through a fill valve or replaceable, as desired. In any event, cartridge 30 is of a substantially identical construction to the cartridge described and shown in the aforementioned U.S. patent application Ser. Nos. 07/056,447 and 06/781,262, both applications having a common assignee herewith and the entire disclosures of both being incorporated herein by reference. Thus, cartridge 30 includes a fuel delivery valve which is actuated by the user.

Figure 5:
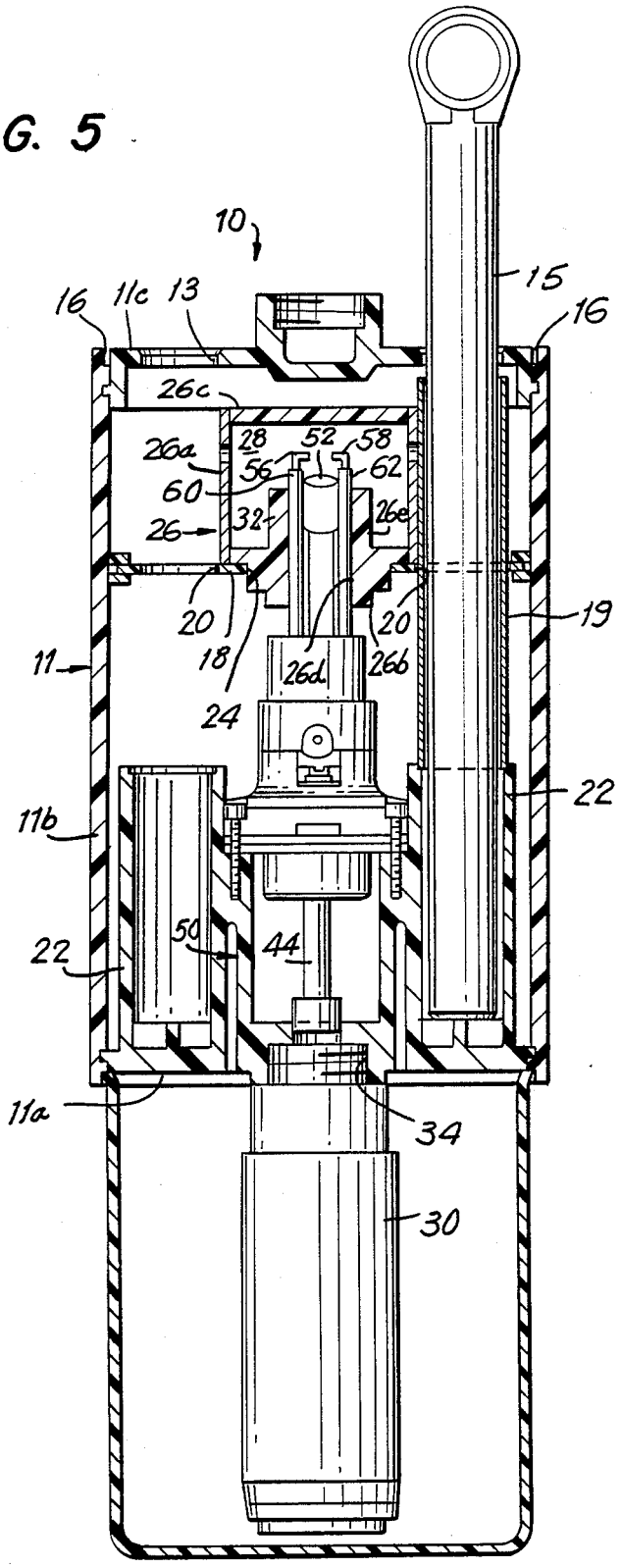
FIG. 5 is a cross-sectional view of the portable hair roller heating device of FIG. 3 with the cover being used as a base support and the cartridge assembled for use.

When not in use, cartridge 30 is screw-threadedly received in a well 32 formed on top wall 11*c* of housing 11, as shown in FIGS. 1–3. When it is intended to heat hair rollers 15, cartridge 30 is unscrewed from well 32 and screwed into an internally screw threaded recess 34 centrally formed in bottom wall 11*a* of housing 11, as shown in FIG. 5.

A switch button 36 (FIG. 2) functions as an ON/OFF switch to start the flow of the butane gas from fuel cartridge 30. Specifically, when switch button 36 is moved upwardly, a spring (not shown) pushes a plunger 44 into a plastic cap of the fuel delivery valve of cartridge 30, in the manner taught in the aforementioned commonly assigned U.S. patent applications to start the flow of fluid fuel from cartridge 30. Then, an ignitor switch button 38 (FIG. 2) is depressed by the user to control a piezoelectric ignitor which ignites the butane to heat chamber 28. Switch buttons 36 and 38 extend through opposite sides of side wall ll*b* of housing 11.

Specifically, switch button 36 includes a switch knob pin 40 which extends through an elongated slot 42 in side wall ll*b* of housing 11. Switch button 36 may be normally biased to a closed position by a spring (not shown). As will be described hereinafter, when switch button 36 is moved downwardly, gas flow is started, and when switch button 36 is moved upwardly, this stops the flow of gas.

As an alternate embodiment of the on-off switch, a lever is arranged so that one end forms a fork with the regulation plunger passing between the tines of the fork. The regulator plunger has a lifting surface normal to its axis located just above the lever fork and above the level of the regulator diaphragm. The other end of the lever is connected to the on-off button. The lever translates a downward motion of the button to an upward motion of the lever fork end which, in turn engages the lifting surface of the regulator plunger, overcoming an opposing force generated by the regulator spring, and thus moves the plunger away from the cartridge valve. This, then, turns off the flow of fuel. When the on-off button is moved upwardly, the lever's forked end drops away from the lifting surface of the regulator plunger which is then forced, by the regulator spring, to contact the cartridge valve to thereby open it and commence the flow of fuel.

Cartridge 30 is always stationary with respect to housing 11, and plunger 44 is caused to move with respect to stationary cartridge 30. Thus, as shown, a lever 46 is pivotally mounted substantially midway along the length thereof by pivot pins 48 within housing 11, in the manner taught in copending U.S. patent application Ser. Nos. 06/825,275 and 07/056,447, the entire disclosures of which have been incorporated herein by reference. It is preferable that the axis of pivot pins 48 be transverse to and intersect the axis of plunger 44, although the actual pivot pins 48 do not intersect plunger 44. Lever 46 has a bifurcated configuration, whereby pivot pins 48 pivotally mount each leg thereof. The upper end 46*a* of lever 46 includes a roller 46*b* rotatably secured thereto between the legs thereof, with roller 46*b*, and thereby lever 46, being pivotally biased about pivot pins 48 by switch button 36. Switch knob pin 40 of switch button 36 extends through and is slidably received in elongated slot 42 in housing 11, so as to abut against roller 46*b*, such that when switch button 36 is moved downwardly, switch knob pin 40 will rotate lever 46 clockwise about pivot pins 48. Accordingly, as taught in the latter two aforementioned copending U.S. patent applications, during such movement, plunger 44 is biased downwardly by a spring (not shown) against the plastic cap of the fuel delivery valve in cartridge 30 to start the flow of gas.

When switch button 36 is moved upwardly, plunger 44 is moved upwardly by the aforementioned arrangement in accordance with the teachings in the latter two aforementioned copending U.S. patent applications. Accordingly, plunger 44 no longer pushes in the plastic cap of the fuel delivery valve, so that the flow of gas is stopped. It will be appreciated that in the OFF position, suitable means is provided for locking switch button 36 in the OFF position.

Plunger 44 is slidably received within a regulator assembly 50. The construction of regulator assembly 50 is identical to that in the aforementioned copending U.S. patent applications. The purpose of regulator assembly 50 is to provide vaporized fuel at constant pressure independent of ambient temperature, fuel consumption rate, orientation, brand of fuel and fuel level. Thus, a known amount of heat is produced at all times, corresponding to fuel consumption. Therefore, temperature regulation is not necessary to maintain barrel temperature during use and because of this, hair roller heating device 10 according to the present invention is easier to assemble and adjust than previously known devices.

As described fully in the aforementioned copending U.S. patent applications, a rubber diaphragm (not shown) is secured in regulator assembly 50. When the pressure of the fuel entering a chamber (not shown) in the regulator assembly 50 becomes too great, the rubber diaphragm is biased against the force of the coil spring (not shown) that normally biases plunger 44, to move plunger 44 away from the fuel delivery valve, whereby a coil spring in the fuel delivery valve causes it to close, halting the flow of gas. Once the gas pressure is reduced by burning the fuel, the first mentioned coil spring moves the rubber diaphragm and plunger 44 to once again open the fuel delivery valve. This cycle continues and maintains a constant pressure on the outlet side of regulator assembly 50 as long as switch button 36 remains in the ON position.

As described in greater detail in the aforementioned U.S. patent applications, a regulator housing of regulator assembly 50 and an inner assembly define two narrow channels (not shown) therebetween through which gas escapes, each channel leading toward a respective orifice-venturi-burner assembly (not shown). Generally, the butane gas is mixed with air from an annular chamber in the orifice-venturi-burner assemblies, as is known. The air-butane vapor mixture from the orifice-venturi-burner assemblies lead to first and second stainless steel burner tubes 52 and 54, respectively, where it is delivered to heating chamber 28 where ignition and combustion occur. Steel burner tubes 52 and 54 extend into heating chamber 28 through inner guide sleeve **26*e*. In heating chamber 28, the fuel is ignited by an electric spark when the ignition switch button 38 is pressed, and burns as long as ON/OFF switch button 36** is ON.

Ignition is accomplished by an electric spark traveling between electrodes 56 and 58 adjacent to the ends of stainless steel tubes 52 and 54, where combustion takes place. Specifically, electrodes 56 and 58 are encased partially in ceramic tubes 60 and 62, respectively, with the ends thereof being exposed at the ends of stainless steel tubes 52 and 54, as shown. The opposite ends of electrodes 56 and 58 extend into electrical contact with a piezoelectric crystal (not shown) which generates a spark when struck by a spring loaded hammer (not shown) when ignition switch button 38 is depressed.

Thus, to operate hair roller heating device 10, switch button 36 is moved to turn ON the flow of butane gas. Then, ignition switch button 38 is pressed once or twice to ignite the gas-air mixture at the end of stainless steel tubes 52 and 54. Accordingly, heating chamber 28 is heated. Because heating chamber 28 is centrally positioned within the plurality of metal tubes 19, the latter are heated thereby and, in turn, heat hair rollers 15.

Thus, with the present invention, hair roller heating device 10 can be made extremely compact in view of the fact that cover 14 also functions as a stand for the device, as shown in FIG. 5, during use. In such arrangement, cartridge 30 is positioned within cover 14 at the bottom of housing 11. During non-use, cartridge 30 is connected to well 32 at the top of housing 11, also within cover 14, as shown in FIGS. 1–3.

Having described a specific preferred embodiment of the invention with reference to the accompanying drawings, it is to be appreciated that the present invention is not limited to that precise embodiment and that various changes and modifications can be effected therein by one of ordinary skill in the art without departing from the spirit and scope of the invention as defined by the appended claims.

What is claimed is:

1. A portable heating appliance comprising: a housing defined by a top wall, side wall and bottom wall, said top wall including a plurality of apertures through which a plurality of elongated objects can be inserted into said housing;

a heating chamber in said housing for heating said objects inserted through said apertures;

at least one burner tube with a free end extending into said heating chamber;

fuel delivery means for supplying fuel to said heating chamber through said at least one burner tube;

ignition means for igniting said fuel supplied to said heating chamber by said at least one burner tube so as to heat said chamber;

first securing means in one wall of said housing for removably connecting a fuel supply cartridge thereto in an inoperative state when said heating appliance is not being used; and second securing means in another wall of said housing for removably connecting the fuel supply cartridge thereto in an operative state to supply fuel to said fuel delivery means when said heating appliance is in use.

2. A portable heating appliance according to claim 1; further comprising a removable cover selectively connectable to said top wall of said housing to cover portions of said objects extending from said top wall.

3. A portable heating appliance according to claim 1; wherein said one wall is in the top wall of the housing.

4. A portable heating appliance according to claim 1; wherein said other wall is the bottom wall of the housing; and further including a removable cover selectively connectable to said top wall to cover portions of said objects extending through said top wall, and to said bottom wall of said housing so as to support said housing; the cartridge being positioned within said cover when the cover is connected to said bottom wall and the cartridge is secured by said second securing means.

5. A portable heating appliance according to claim 1; wherein said objects to be heated are flexible hair rollers.

6. A portable heating appliance according to claim 1; wherein the cartridge has external screw threads, and said first securing means includes a well defined in said one wall, said well having internal screw threads for screw-threadedly receiving the cartridge therein in an inoperative state.

7. A portable heating appliance according to claim 1; wherein the cartridge has external screw threads, and said second securing means includes a well defined in said other wall, said well having internal screw threads for screw-threadedly receiving the cartridge therein in an operative state so as to fluidly connect the cartridge to said fuel delivery means.

8. A portable heating appliance according to claim 1, further including a plurality of heat conducting tube means positioned adjacent said heating chamber and in line with said plurality of apertures for supporting said objects to be heated in said housing and for conducting heat to said objects from said heating chamber.

9. A portable heating appliance comprising:

(a) a housing defined by a top wall, side wall and bottom wall, said top wall including a plurality of apertures through which a plurality of elongated objects can be inserted into said housing;

(b) a heating chamber in said housing for heating said objects inserted through said apertures;

(c) at least one burner tube with a free end extending into said heating chamber;

(d) fuel delivery means for supplying fuel to said heating chamber through said at least one burner tube;

(e) ignition means for igniting said fuel supplied to said heating chamber by said at least one burner tube so as to heat said chamber;

(f) a removable cover selectively connectable to:

(i) said top wall to cover portions of said objects extending through said top wall, and (ii) said bottom wall of said housing so as to support said housing;

(g) first securing means in said top wall for removably connecting a fuel supply cartridge thereto when said heating appliance is not being used;

(h) second securing means in said bottom wall for removably connecting the fuel supply cartridge thereto to supply fuel to said fuel delivery means when said heating appliance is in use; and (i) the cartridge being positioned within said cover when the cover is connected to said top wall and the cartridge is secured by said first securing means, and the cartridge being positioned within said cover when the cover is connected to said bottom wall and the cartridge is secured by said second securing means.

10. A portable heating appliance according to claim 9; wherein said objects to be heated are flexible hair rollers.

11. A portable heating appliance according to claim 9; wherein the cartridge has external screw threads, and said first securing means includes a well defined in said top wall, said well having internal screw threads for screw-threadedly receiving the cartridge therein in an inoperative state.

12. A portable heating appliance according to claim 9; wherein the cartridge has external screw threads, and said second securing means includes a well defined in said bottom wall, said well having internal screw threads for screw-threadedly receiving the cartridge therein in an operative state so as to fluidly connect the cartridge to said fuel delivery means.

13. A portable heating appliance according to claim 9; further including a plurality of heat conducting tube means positioned adjacent said heating chamber and in line with said plurality of apertures for supporting said objects to be heated in said housing and for conducting heat to said objects from said heating chamber.

14. A portable heating appliance comprising:

(a) a housing defined by a top wall, side wall and bottom wall, said top wall including a plurality of apertures through which a plurality of elongated hair rollers can be inserted into said housing;

(b) a heating chamber in said housing for heating said hair rollers inserted through said apertures;

(c) at least one burner tube with a free end extending into said heating chamber;

(d) fuel delivery means for supplying fuel to said heating chamber through said at least one burner tube;

(e) ignition means for igniting said fuel supplied to said heating chamber by said at least one burner tube so as to heat said chamber;

(f) a plurality of heat conducting tube means positioned adjacent said heating chamber and in line with said plurality of apertures for supporting said hair rollers in said housing and for conducting heat to said hair rollers from said heating chamber;

(g) a removable cover selectively connectable to:

(i) said top wall to cover portions of said hair rollers extending through said top wall, and (ii) said bottom wall of said housing so as to support said housing;

(h) first securing means in said top wall for removably connecting a fuel supply cartridge having external screw threads thereto when said heating appliance is not being used, said first securing means including a well defined in said top wall, said well having internal screw threads for screw-threadedly receiving the cartridge therein in an inoperative state;

(i) second securing means in said bottom wall for removably connecting the fuel supply cartridge thereto to supply fuel to said fuel delivery means when said heating appliance is in use, said second securing means including a well defined in said bottom wall, said well having internal screw threads for screw-threadedly receiving the cartridge therein in an operative state so as to fluidly connect the cartridge to said fuel delivery means; and (j) the cartridge being positioned within said cover when the cover is connected to said top wall and the cartridge is secured by said first securing means, and the cartridge being positioned within said cover when the cover is connected to said bottom wall and the cartridge is secured by said second securing means.

15. A portable heating appliance for a plurality of hair rollers comprising:

(a) a housing having a plurality of heat transfer members comprising a plurality of tubes through which said plurality of hair rollers are insertable for heating by said appliance;

(b) a heating chamber in said housing for heating said heat transfer members;

(c) at least one burner tube with a free end extending into said heating chamber;

(d) fuel delivery means for providing fuel to said heating chamber through said at least one burner tube;

(e) ignition means for igniting said fuel supplied to said heating chamber by said at least one burner tube so as to heat said chamber;

(f) securing means in said housing for selectively and removably connecting the outlet port of a fuel supply cartridge to said fuel delivery means; and (g) connecting means alternatively usable with said securing means for selectively securing said outlet port of said fuel supply cartridge to said housing in a manner such that fuel is not supplied to said fuel delivery means and, yet, said outlet port of said fuel supply cartridge is not exposed.

16. A portable heating appliance as claimed in claim 15, wherein said connecting means and said securing means are located at opposite ends of said housing.

17. A portable heating appliance as claimed in claim 15, wherein said housing is further provided with a removable cover for protecting said fuel supply cartridge when secured to said securing means.

* * * * *